US007891835B2

(12) United States Patent
Wilcox

(10) Patent No.: US 7,891,835 B2
(45) Date of Patent: Feb. 22, 2011

(54) LIGHT-DIRECTING APPARATUS WITH PROTECTED REFLECTOR-SHIELD AND LIGHTING FIXTURE UTILIZING SAME

(75) Inventor: Kurt S. Wilcox, Libertyville, IL (US)

(73) Assignee: Ruud Lighting, Inc., Racine, WI (US)

( * ) Notice: Subject to any disclaimer, the term of this patent is extended or adjusted under 35 U.S.C. 154(b) by 365 days.

(21) Appl. No.: 12/173,149

(22) Filed: Jul. 15, 2008

(65) Prior Publication Data

US 2010/0014290 A1 Jan. 21, 2010

(51) Int. Cl.
*F21V 13/04* (2006.01)

(52) U.S. Cl. ..... 362/245; 362/248; 362/328

(58) Field of Classification Search ..... 362/217.02, 362/217.05, 242–248, 327, 328, 509, 520
See application file for complete search history.

(56) References Cited

U.S. PATENT DOCUMENTS

| | | | | |
|---|---|---|---|---|
| 1,917,665 | A * | 7/1933 | Rush | 362/244 |
| 3,537,028 | A | 10/1970 | Pankove | |
| 3,808,424 | A * | 4/1974 | Rijnders | 362/308 |
| 4,232,359 | A | 11/1980 | Leon et al. | |
| 5,130,761 | A | 7/1992 | Tanaka | |
| 5,526,239 | A * | 6/1996 | Sato | 362/461 |
| 6,296,382 | B1 * | 10/2001 | Hamelbeck | 362/544 |
| 6,325,524 | B1 | 12/2001 | Weber et al. | |
| 6,619,825 | B2 * | 9/2003 | Natsume | 362/509 |
| 6,674,096 | B2 | 1/2004 | Sommers | |
| 6,709,139 | B2 * | 3/2004 | Ishida et al. | 362/509 |
| 6,837,605 | B2 | 1/2005 | Reill | |
| 6,953,265 | B2 | 10/2005 | Suehiro et al. | |
| 6,969,946 | B2 | 11/2005 | Steranka et al. | |
| 6,972,439 | B1 | 12/2005 | Kim et al. | |
| 7,009,213 | B2 | 3/2006 | Camras et al. | |
| 7,025,487 | B2 * | 4/2006 | Holzmann et al. | 362/546 |
| 7,080,932 | B2 | 7/2006 | Keuper | |
| 7,118,262 | B2 | 10/2006 | Negley | |
| 7,153,002 | B2 | 12/2006 | Kim et al. | |
| 7,182,480 | B2 | 2/2007 | Kan | |
| 7,244,924 | B2 | 7/2007 | Kiyomoto et al. | |
| 7,255,458 | B2 | 8/2007 | Ashdown | |
| 7,300,183 | B2 | 11/2007 | Kiyomoto et al. | |

(Continued)

OTHER PUBLICATIONS

Excerpts of International Search Report and Written Opinion for PCT/US09/03900. Date: Aug. 24, 2009. 4 pages.

*Primary Examiner*—Jong-Suk (James) Lee
*Assistant Examiner*—Stanley Weinberg
(74) *Attorney, Agent, or Firm*—Jansson Shupe & Munger Ltd.

(57) ABSTRACT

A light-directing apparatus for off-axial preferential-side distribution of light from a light emitter having an emitter axis, including a lensing member positioned over the light emitter a shield member embedded within the lensing member in a position in the path of light emitted toward a non-preferential side. The lensing member having a proximal end substantially transverse the emitter axis and an outer surface configured for refracting light from the emitter. The shield member may be snugly received in a shield-receiving void of an inner surface of the lensing member. Alternatively, the shield member is embedded by the lensing member having been molded thereabout. Another aspect of this invention is a lighting fixture utilizing such light-directing apparatus.

31 Claims, 13 Drawing Sheets

U.S. PATENT DOCUMENTS

| | | | | |
|---|---|---|---|---|
| 7,314,296 | B2 | 1/2008 | Machi et al. | |
| 7,316,488 | B2 | 1/2008 | Wall, Jr. | |
| 7,452,115 | B2 * | 11/2008 | Alcelik | 362/516 |
| 2002/0181244 | A1 * | 12/2002 | Griffin | 362/527 |
| 2006/0138440 | A1 | 6/2006 | Jyo | |
| 2006/0227566 | A1 * | 10/2006 | Lee | 362/509 |
| 2008/0117646 | A1 | 5/2008 | Yatsuda et al. | |
| 2010/0039810 | A1 | 2/2010 | Holder et al. | |

* cited by examiner

61

11

12

PLOT OF ILLUMINATION DISTRIBUTION
FROM A COMPARABLE APPARATUS
NOT USING THE PRESENT INVENTION

LIGHT-DIRECTING APPARATUS WITH PROTECTED REFLECTOR-SHIELD AND LIGHTING FIXTURE UTILIZING SAME

FIELD OF THE INVENTION

The invention relates generally to the field of lighting systems and, more particularly, to apparatus for utilizing LED light sources for illuminating areas with predefined patterns of light intensity.

BACKGROUND OF THE INVENTION

There is a continuing need for lighting apparatus which is low-cost and energy efficient. LEDs (light-emitting diodes) provide light sources which are energy efficient, and advances in LED technology are providing even greater efficiencies over time.

Some of the newer applications for LED-based lighting systems are roadway and parking lot lighting in which there are desired performance and light-distribution characteristics. More specifically, it is desirable that certain regions generally beneath a light fixture be illuminated, while certain neighboring regions are essentially non-illuminated. Along roadways and in parking lots, there is a need to be able to direct light in a particular preferential lateral direction (e.g., to illuminate a roadway) while avoiding so-called "trespass light" in an opposite lateral direction (a non-preferential lateral direction), e.g., toward roadside houses.

The importance of avoiding trespass light (or the like) is such that in some cases sacrifices are made in lighting efficiency, by virtue of allowing absorption of tight by shielding members. It would be highly desirable to provide a high-efficiency LED lighting system for roadways, parking lots and the like that avoids trespass light without significant efficiency losses.

It would be further desirable to provide a lighting fixture that maintains the desired light-directing characteristics and efficiency of operation at a substantially constant level throughout the fixture life. Such continued combination of advantages can be difficult to achieve because of susceptibility of light-managing components to damage, degradation and wear over a period of time.

OBJECTS OF THE INVENTION

It is an object of this invention to provide a light-directing apparatus and lighting fixture, preferably LED-based devices, which distribute light from light emitters in a preferential lateral direction and which overcomes some of the problems and shortcomings of the prior art.

Another object of this invention is to provide light-directing apparatus and lighting fixture which maximize the light directed toward a preferential side and minimize light directed toward the opposite (non-preferential) side.

Another object of this invention is to provide lighting fixtures for uses such as roadway and parking-lot illumination that have high-efficiency light-directing apparatus while satisfying requirements for minimizing trespass light.

Still another object of this invention is to provide a light-directing apparatus which directs a maximum amount of emitted light toward an area intended to be illuminated.

Yet another object of this invention is to provide an LED-based light-directing apparatus which maintains the light-directing characteristics at a substantially constant level throughout its life.

Another object of this invention is to provide an LED-based light-directing apparatus having light-managing components which are protected from damage, degradation and wear over an extended period of time, even in difficult use environments.

These and other objects of the invention will be apparent from the following descriptions and the drawings.

SUMMARY OF THE INVENTION

One aspect of the present invention is an improved light-directing apparatus for off-axial preferential-side distribution of light from a light emitter which has an emitter axis. Another aspect of this invention is a lighting fixture utilizing such light-directing apparatus.

The inventive light-directing apparatus includes a lensing member positioned over the light emitter and a shield member. The lensing member has a proximal end substantially transverse the emitter axis and an outer surface configured for refracting light from the emitter.

The shield member may be embedded within the lensing member in a position in the path of light emitted toward the non-preferential side. In some of such embodiments, the shield member is embedded by the lensing member having been molded thereabout.

In some preferred embodiments, the proximal end defines a shield-insertion opening. In such embodiments, the lensing member further includes an inner surface defining an off-axis shield-receiving void extending from the shield-insertion opening. The shield member is snugly received in the shield-receiving void in a position in the path of light emitted toward a non-preferential side. The positioning of the shield-receiving void and the shield member therein are preferably such that the shield is off-set from the emitter axis.

The proximal end of the lensing member may further define an emitter-insertion opening and the inner surface defines an emitter-receiving void extending from the emitter-insertion opening and facing the emitter. The shield-insertion opening and the emitter-receiving opening are preferably in communication and form a single proximal-end opening. The shield-receiving void is preferably contiguous with the emitter-receiving void. The lensing member is most typically bilaterally symmetric, as is the shield member.

The outer surface of the lensing member is preferably a compound surface configured for refracting light from the emitter in a predominantly off-axial direction toward a preferential side. One type of a compound outer surface is disclosed in U.S. Pat. No. 7,618,163, the contents of which are incorporated herein by reference. The term "compound surface," as used herein with respect to the outer surface of a lensing member (a lens), means a surface having portions of differing geometric shapes and/or including inflection regions between different portions thereof, e.g., convex portions on either side of a concave portion. "Compound surface" does not imply any particular shape, but the shape will be chosen for the desired lensing properties.

In preferred embodiments, the shield member includes a reflective front surface in the path of light emitted toward the non-preferential side to redirect such light toward the preferential side. The shield member may be formed of various plastic materials with a reflective coating. Such coated plastics are known to have a light-reflecting efficiency of about 85%. A sill more efficient alternative is an anodized metal, such as aluminum, which provides a higher light-reflection efficiency, of about 95%.

The reflective front surface is preferably entirely within the lensing member. Such enclosure provides highly desirable protection for the reflective surface, virtually eliminating damage, degradation and wear from exposure to elements.

The reflective front surface of the shield member is preferably of non-planar configuration. In some embodiments, the reflective front surface may have a plurality of sections angled with respect to each other. The sections may each be substantially planar. Alternatively, the reflective front surface may be formed by a single section, which may be flat or curved. The exact configuration of the shield portion, and its reflective front surface, whether it is planar or has a radius of curvature, are chosen to achieve the desired light-emitting characteristic for whatever product is being developed.

In preferred embodiments, the shield member includes a shield portion and a base portion. The reflective front surface is on the shield portion that extends from the base portion into the path of light emitted toward the non-preferential side. The base portion extends from the shield portion away from the light emitter at the proximal end of the lensing member.

In preferred embodiments of the inventive light-directing apparatus, the light emitter is an LED package which includes at least one LED and a primary lens over the LED. In such embodiments, the lensing member is a secondary lens placed over the primary lens, and the reflective front surface faces the primary lens. In some other embodiments, there is space between the primary and secondary lenses and the space is filled with optical-grade gel. In preferred embodiments, the primary lens is substantially rotationally symmetrical around the emitter axis; preferably the primary lens is substantially hemispherical.

The term "LED package" is well known in the industry. LED packages have either a single light-emitting diode (LED) or a few closely-spaced LEDs on a base. Many LED packages include a primary reflector, which may be in the form of a so-called reflector cup mounted to the base or a reflective surface associated with the primary lens proximal the LED(s). One example of LED packages illustrated here in connection with the present invention includes a ring, preferably made of aluminum, around the primary lens on the base, which ring serves to position the primary lens and to reflect some light from the emitter to assist in the generation of an illumination pattern. Persons skilled in the art will appreciate that a broad variety of available LED packages are useful with the light-directing apparatus of the present invention.

The lensing member preferably includes an outward flange around the opening(s) at the proximal end. The flange has an inner surface facing the mounting board. The base portion of the shield member is preferably at least partially against the inner surface of the flange. The outward flange may include a reference mark indicating an orientation with respect to the preferential side. Alternatively, the flange may have a specific shape, such as cut corners or the like, to indicate the orientation with respect to the preferential side. Such features are helpful in assembly of lighting fixtures using such light-directing apparatus.

The lighting fixture of this invention utilizes a plurality of light emitters, preferably LED packages, spaced from one another on a mounting board and oriented with substantially parallel axes. A light-directing apparatus is positioned over the light emitters for off-axial preferential-side distribution of light from the emitters. The light-directing apparatus includes a plurality of lenses, each positioned over one light emitter, and a plurality of shield members. Each lens has a proximal end transverse the emitter axis and defines a shield-insertion opening. Each lens has an inner surface defining an off-axis shield-receiving void extending from the shield-insertion opening, and a compound outer surface configured for refracting light from the emitter in a predominantly off-axial direction toward a preferential side. Each shield member is snugly received in the shield-receiving void of a corresponding one of the lenses in a position in the path of light emitted from the corresponding light emitter toward a non-preferential side.

In some embodiments of the inventive lighting fixture, the lenses have preferential sides in the same lateral direction, thereby to facilitate illumination toward one lateral direction.

In other embodiments, the lenses have preferential sides in different lateral directions, thereby to facilitate illumination in different lateral directions. The lenses may be arranged in a substantially circular pattern, and each lens has a preferential side oriented in a substantially radially outward direction with respect to the circular pattern. Some of such other embodiments may have subsets of the emitters and the corresponding lenses, with the subsets configured for directing light in different lateral directions.

One example of such other embodiments may have two subsets, one subset with its light-directing apparatuses configured for directing light toward a broad area (e.g., of a parking lot), and another smaller subset with its light-directing apparatuses configured for illumination of an adjacent sidewalk. In some other examples of the above-described embodiments, the emitters and their corresponding lenses are arranged in a substantially circular pattern, with each lens having a preferential side oriented in a substantially radially outward direction with respect to the circular pattern.

In the preferred embodiment, which are illustrated, each lensing member (secondary lens) is a separate piece. In certain other embodiments, the plurality of lenses in the light-directing apparatus maybe formed as portions of a single unitary piece, with the lens portions each positioned for proper placement over its corresponding emitter.

The term "preferential side," as used herein with respect to the light-distribution direction, means the lateral direction (with respect to the emitter axis) toward which illumination is desired. The term "non-preferential side," as used herein with respect to the direction of the light distribution, means the lateral direction toward which illumination is not desired. The non-preferential side is typically substantially radially opposite from the preferential side.

The term "snugly," as used herein with respect to positioning of the shield member inside the lensing member, means that inner surface of the lensing member which defines the shield-receiving void is configured for fitting closely against at least a portion of the shield-member surfaces to support the shield member in substantially fixed position with respect to the emitter axis. In other words, the shield-receiving void and the shield member are configured for a mating relationship sufficient to fix the position of the shield member with respect to the lensing member, whether or not all surfaces of the shield member are in contact with surfaces of the lensing member.

The term "being in communication," when used in reference to the emitter-insertion opening and the shield-insertion opening, means that the emitter-insertion opening may encompass the entire shield-insertion opening or that such openings may partially overlap. In either case, the term "being in communication" means that there is no barrier between such openings. (It should be understood that "opening" does not refer to something having volume, while "void" does imply volume.)

DETAILED DESCRIPTION OF PREFERRED EMBODIMENTS

Figure 1:
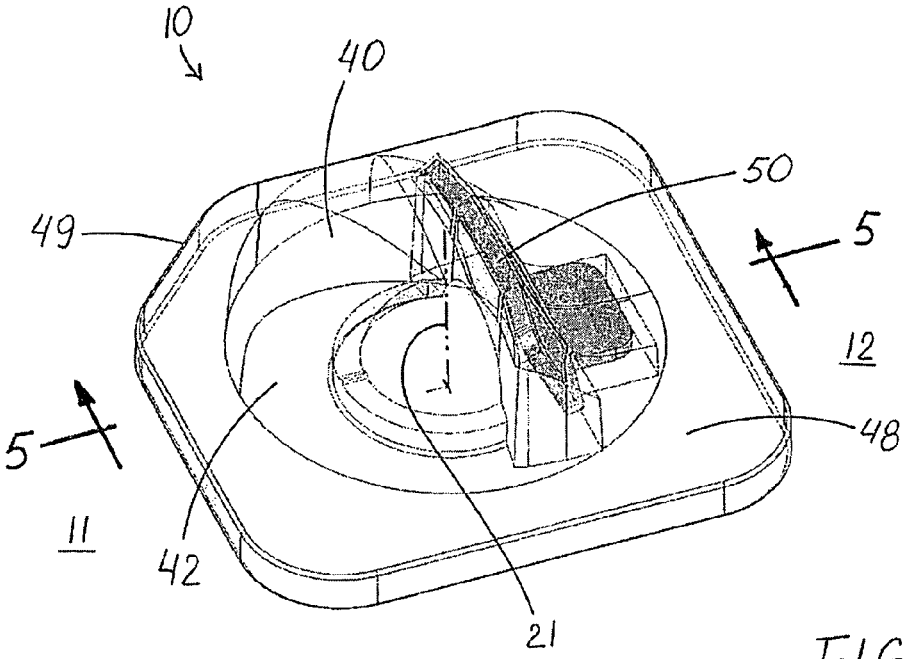
FIG. 1 is a perspective view of one embodiment of the light-directing apparatus of the invention, having a shield member inserted into a lensing member.
Figure 2:
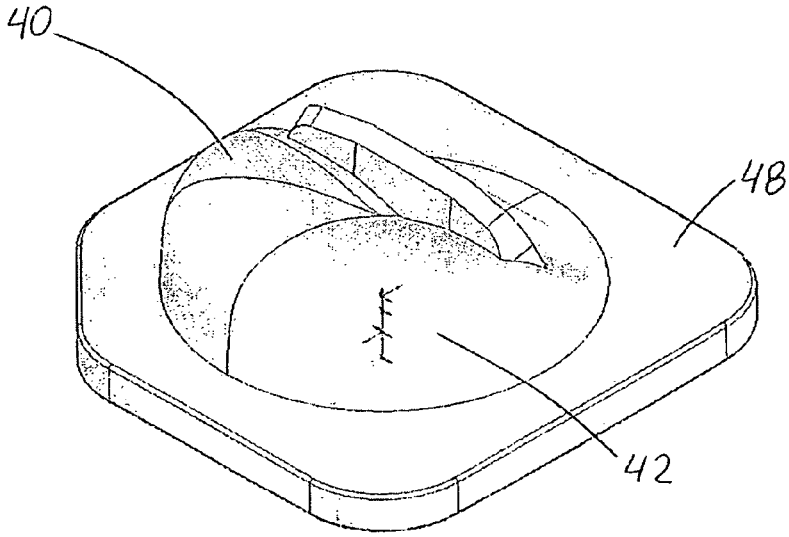
FIG. 2 is an opaque perspective view of the lensing member of FIG. 1. (The lensing member, of course, is light-transmissive rather than opaque as here shown; the opaque view helps in understanding the shape of the outer surface.)
Figure 3:
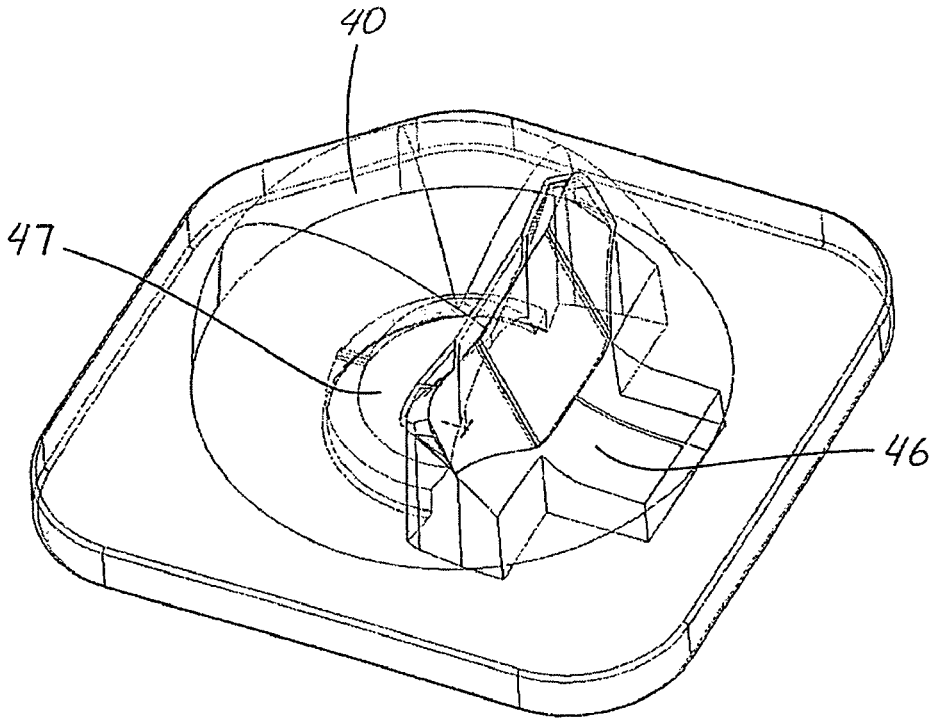
FIG. 3 is a perspective transparent view of the lensing member without the shield member.
Figure 4:
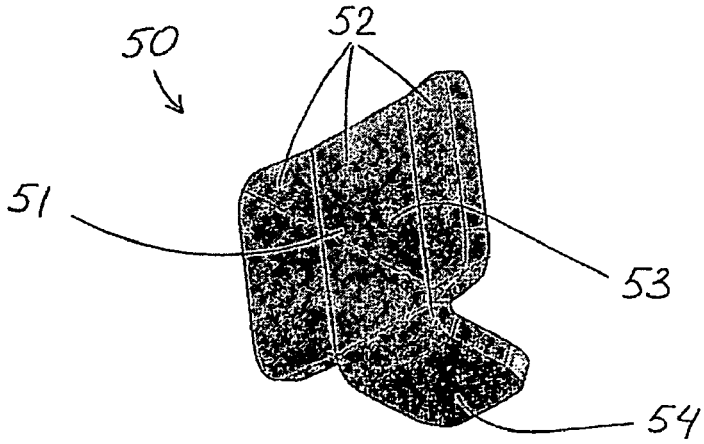
FIG. 4 is a perspective view of the shield member.

FIGS. 1-14 show preferred embodiments of an inventive light-directing apparatus 10 in accordance with this invention for off-axial preferential-side distribution of light from a light emitter 20 which has an emitter axis 21. FIGS. 15-19 illustrate preferred embodiments of another aspect of this invention which is a lighting fixture 30 utilizing light-directing apparatus 10.

Inventive light-directing apparatus 10 includes a lensing member 40 positioned over light emitter 20 and a shield member 50. As best seen in FIGS. 3, 5 and 7-9, lensing member 40 has a proximal end 41 substantially transverse emitter axis 21 and an outer surface 42 configured for refracting light from emitter 20. In such embodiments, shield member 50 has been inserted into lensing member 40.

Figure 6:
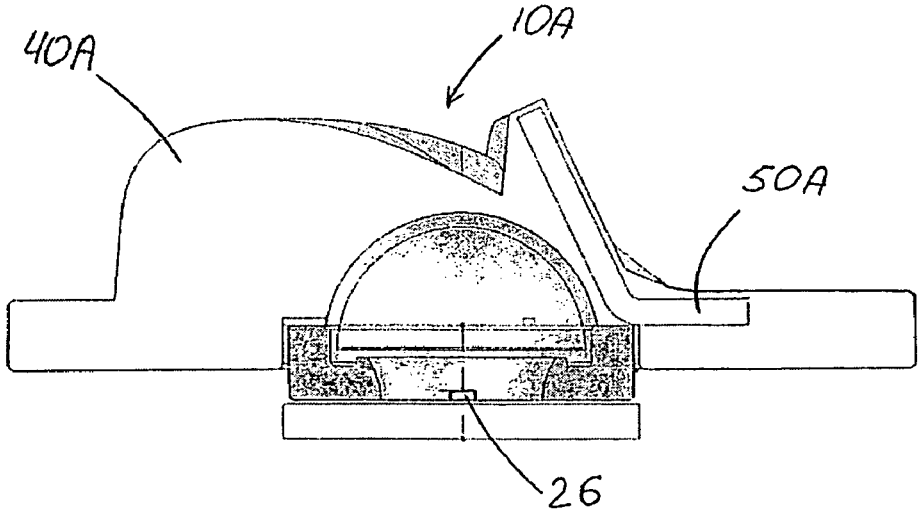
FIG. 6 is a similar cross-sectional view, but of another embodiment of the light-directing apparatus of this invention, in this case with the shield member embedded within the lensing member.

FIG. 6 shows a light-directing apparatus 10A which is another embodiment of the invention, in this case with shield member 50A embedded within lensing member 40A in a position in the path of light emitter toward the non-preferential side 12. Shield member 50A is embedded in lensing member 40A by such lensing member having been molded thereabout.

Figure 5:
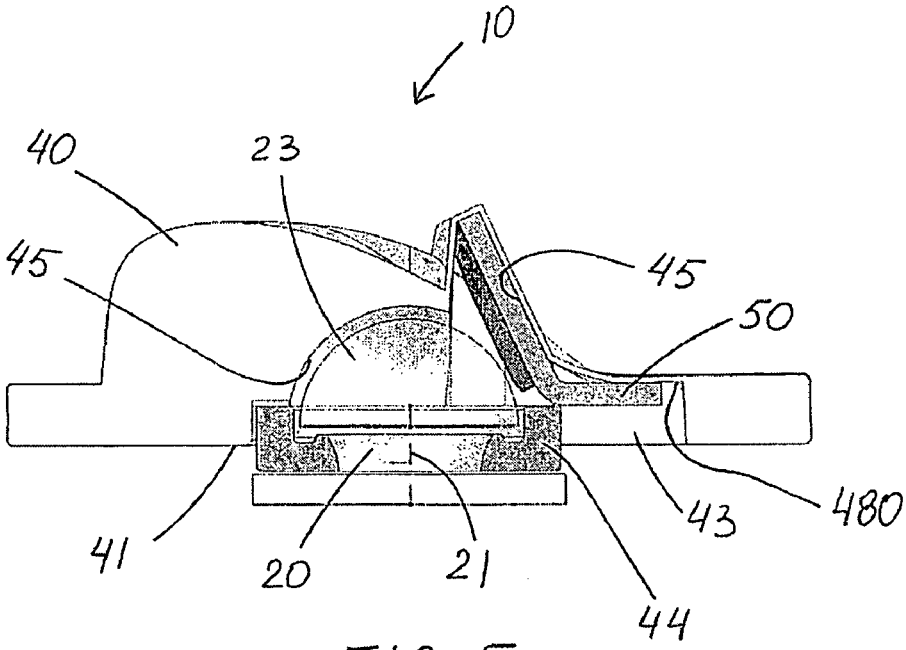
FIG. 5 is a sectional view of the light-directing apparatus, taken along section 5-5 as shown in FIG. 1.
Figure 7:
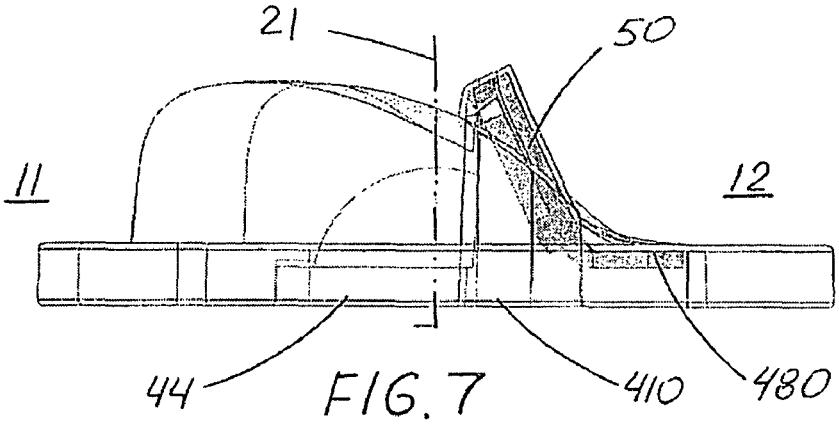
FIG. 7 is a front elevation of the light-directing apparatus of FIG. 1.
Figure 8:
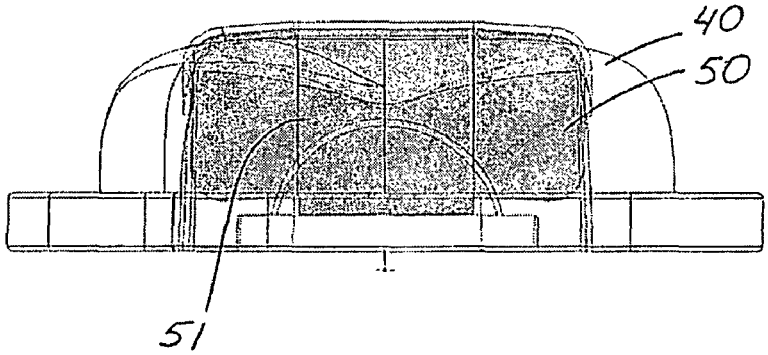
FIG. 8 is a left-side view of FIG. 7, which views the light-directing apparatus from the preferential illumination side.
Figure 9:
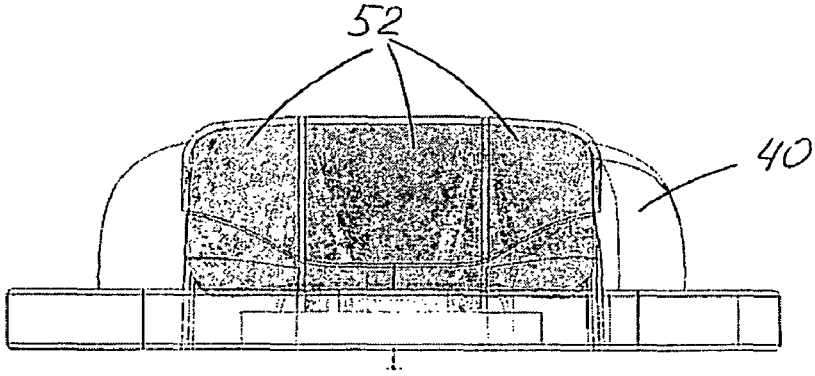
FIG. 9 is a right-side view of FIG. 7, which views the light-directing apparatus from the non-preferential illumination side.

FIGS. 5 and 7-9 illustrate that proximal end 41 of light-directing apparatus 10 defines a shield-insertion opening 43. Lensing member 40 further includes an inner surface 45 which defines an off-axis shield-receiving void 46 extending from shield-insertion opening 43 and terminating at a close end. Shield member 50 is snugly received in shield-receiving void 46 in a position in the path of light emitted toward non-preferential side 12. As best seen in FIGS. 5 and 7, the positioning of shield-receiving void 46 and shield member 50 therein are such that shield 50 is off-set from emitter axis 21.

Figure 10:
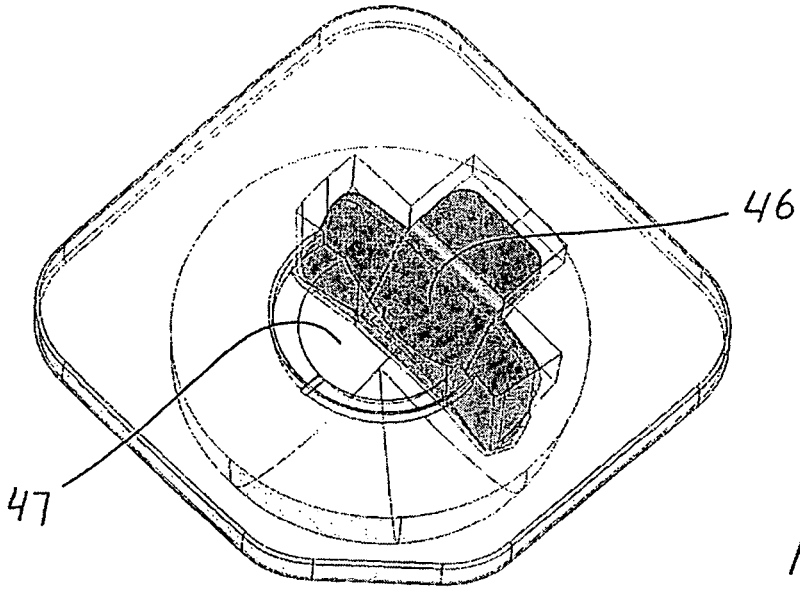
FIG. 10 is a perspective view from below of the light-directing apparatus of FIG. 1.
Figure 11:
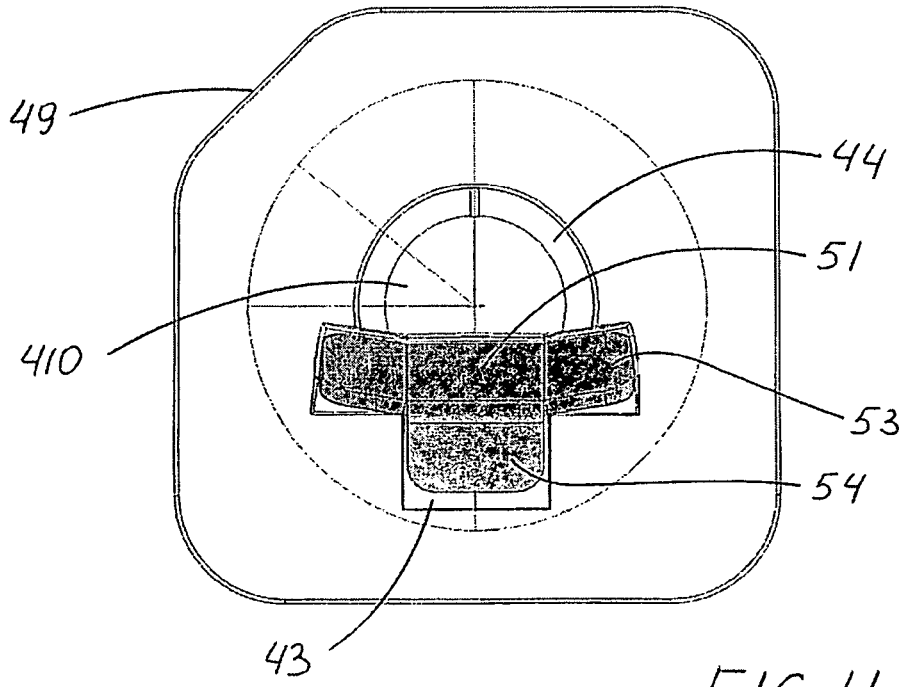
FIG. 11 is a bottom plan view of FIG. 1.
Figure 12:
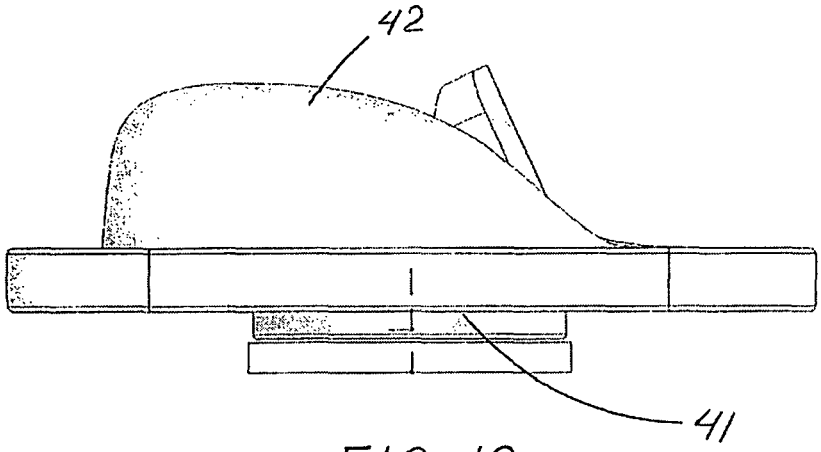
FIG. 12 is a front elevation of the light-directing apparatus as shown in FIG. 2, with the lensing member opaque for viewing purposes and including an emitter used with such lensing member.
Figure 13:
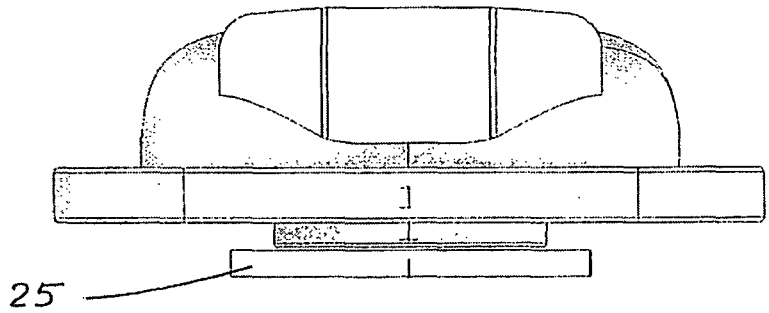
FIG. 13 is a right-side view of FIG. 12, which views the light-directing apparatus from the non-preferential illumination side.
Figure 14:
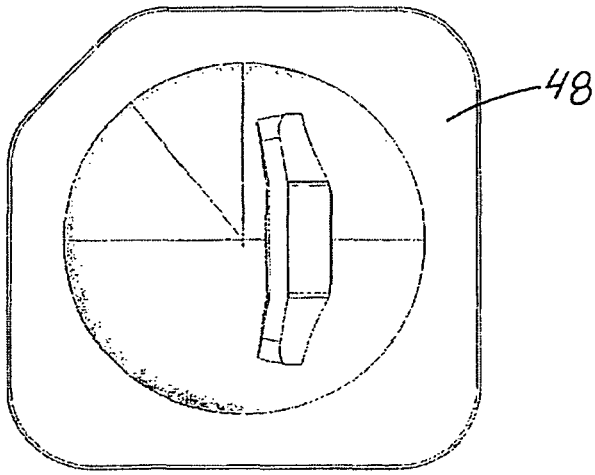
FIG. 14 is a top plan view of FIG. 2.

As best illustrated in FIGS. 5, 10 and 11, proximal end 41 of lensing member 40 further defines an emitter-insertion opening 44. Inner surface 45, mentioned above, in addition to defining shield-receiving void 46, further defines an emitter-receiving void 47 extending from emitter-insertion opening 44 and facing emitter 20. It can be seen that shield-insertion opening 43 and emitter-receiving opening 44 are in communication and form a single proximal-end opening 410. As is further seen in FIG. 7, shield-receiving void 46 is contiguous with emitter-receiving void 47.

FIGS. 1, 3-14 show outer surface 42 of lensing member 40 as a compound surface configured for refracting light from emitter 20 in a predominantly off-axial direction toward a preferential side 11. Lensing member 40 is shown to be bilaterally symmetric, as is shield member 50.

Shield member 50 includes a reflective front surface 51 in the path of light emitted toward non-preferential side 12 to redirect such light toward preferential side 11. Reflective front surface 51 is entirely within lensing member 40.

FIGS. 1, 4, 10 and 11 show a preferred embodiment in which reflective front surface 51 of shield member 50 is of non-planar configuration. Reflective front surface 51 has a plurality of sections 52 angled with respect to each other. As further seen in FIG. 4, sections 52 are each substantially planar.

Shield member 50 further includes a shield portion 53 which extends from a base portion 54 into the path of light emitted toward non-preferential side 12. Base portion 54 extends from shield portion 53 away from light emitter 20 at proximal end 41 of lensing member 40. Reflective front surface 51 is on shield portion 53.

Figure 22:
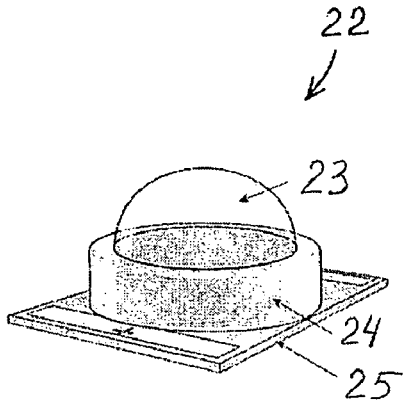
FIG. 22 is a perspective view of one type of an LED package with which the light-directing apparatus of this invention is used.

FIGS. 5, 6 and 22 illustrate light emitter 20 as an LED package 22 which includes an LED 26 and a primary lens 23 over the LED. As seen in FIGS. 5 and 6, lensing member 40 is a secondary lens placed over primary lens 23, with reflective front surface 51 of shield member 50 generally facing primary lens 23. FIGS. 5, 6 and 22 show primary lens 23 as substantially rotationally symmetrical around emitter axis 21. Primary lens 23 is substantially hemispherical.

Figure 23:
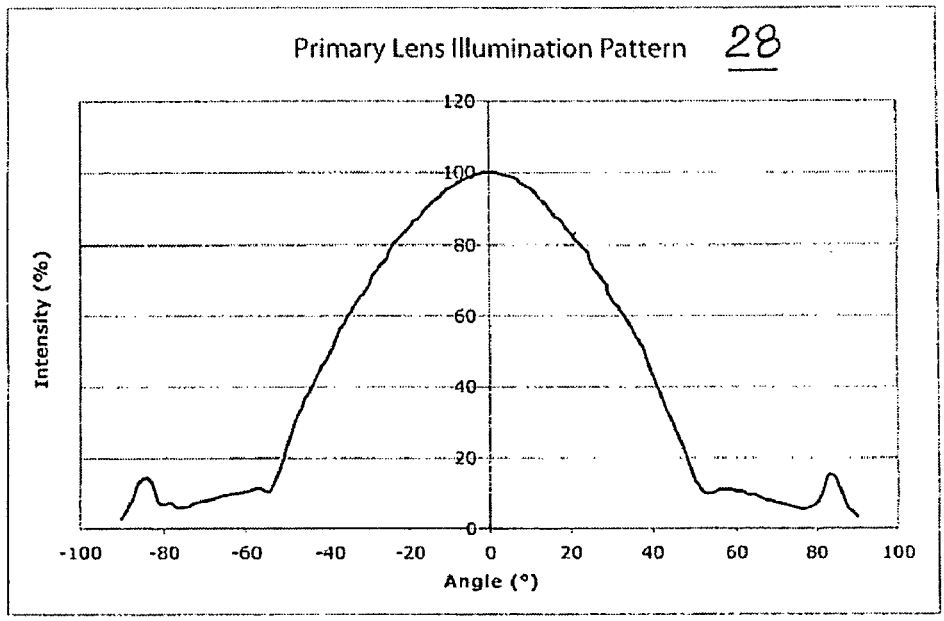
FIG. 23 is a graphical representation of the illumination pattern of the LED package of FIG. 22, showing the axially symmetrical light emission which is then modified by the light-directing apparatus of this invention.

LED package 22 shown in FIG. 22 includes a ring 24 around primary lens 23 on a base 25. Ring 24 serves to position lens 23 and reflect some light from the LED to assist in generation of illumination pattern 28, illustrated in FIG. 23.

Figure 15A:
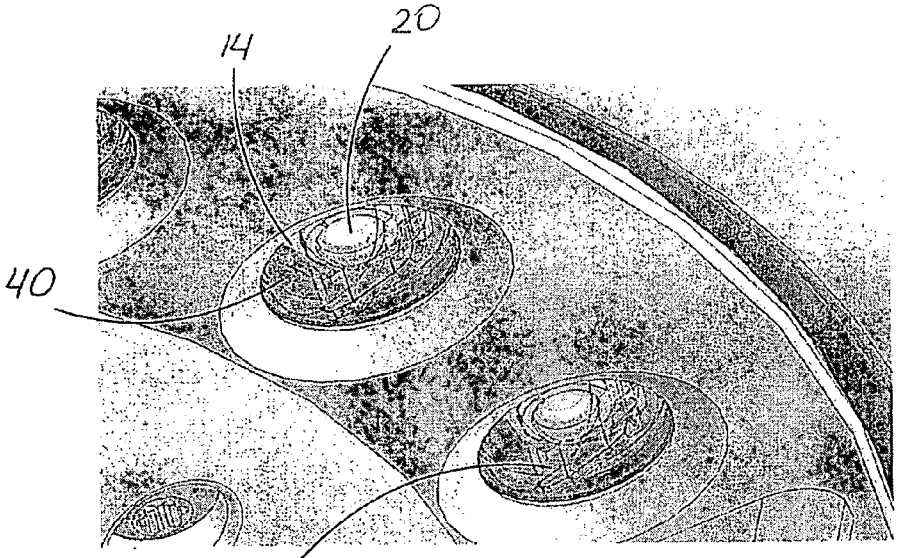
FIG. 15A is an enlarged fragmentary view of FIG. 15.
Figure 15:
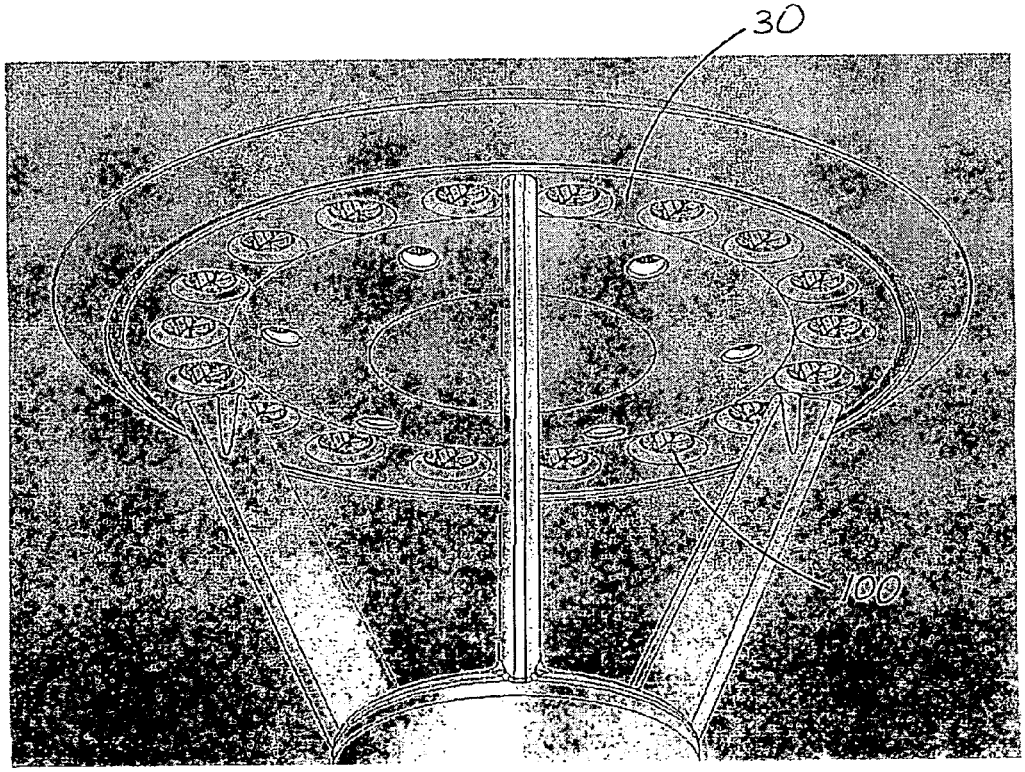
FIG. 15 is a perspective view from below of a lighting fixture according to the present invention.

Lensing member 40 includes an outward flange 48 around the opening(s) at proximal end 41. Flange 48, and thus lensing member 40, are secured with respect to a mounting board 14 which is part of a lighting fixture that includes a plurality of light-directing apparatuses of the sort described. (See FIG. 15A.) Flange 48 has an inner surface 480 facing mounting board 14 when mounted thereon. (See FIGS. 5 and 7.) Base portion 54 of shield member 50 is shown to be against inner surface 480 of flange 48. Flange 48 is further shown to have a special shape 49 such as a cut corner, to indicate the orientation with respect to preferential side 11. Such feature is helpful in assembly of lighting fixtures using light-directing apparatus 10.

Lighting fixture 30 shown in FIGS. 15-19 utilizes a plurality of light emitters 20 spaced from one another on mounting board 14 and oriented with substantially parallel axes. A light-directing apparatus 100 is positioned over light emitters 20 for off-axial preferential-side distribution of light from emitters 20. Light-directing apparatus 100 includes a plurality of lenses each of which is like lensing member 40 and is positioned over one light emitter 20, and each has a shield member 50 associated with it, as described with respect to light-directing apparatuses 10 or 10A. Lenses 40 are arranged in a substantially circular pattern.

Figure 16:
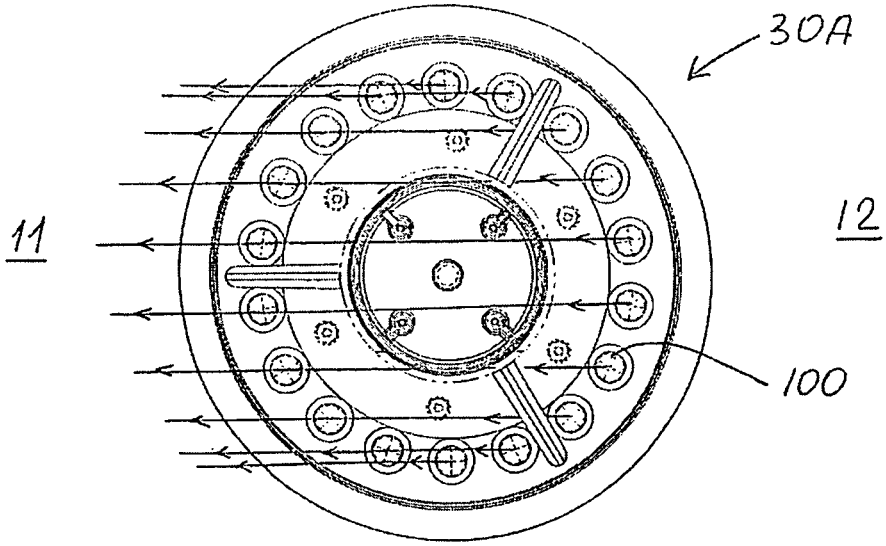
FIG. 16 is a reduced bottom plan view of the lighting fixture of FIG. 15, excluding the pole portion, but showing illumination toward a common lateral direction.
Figure 17:
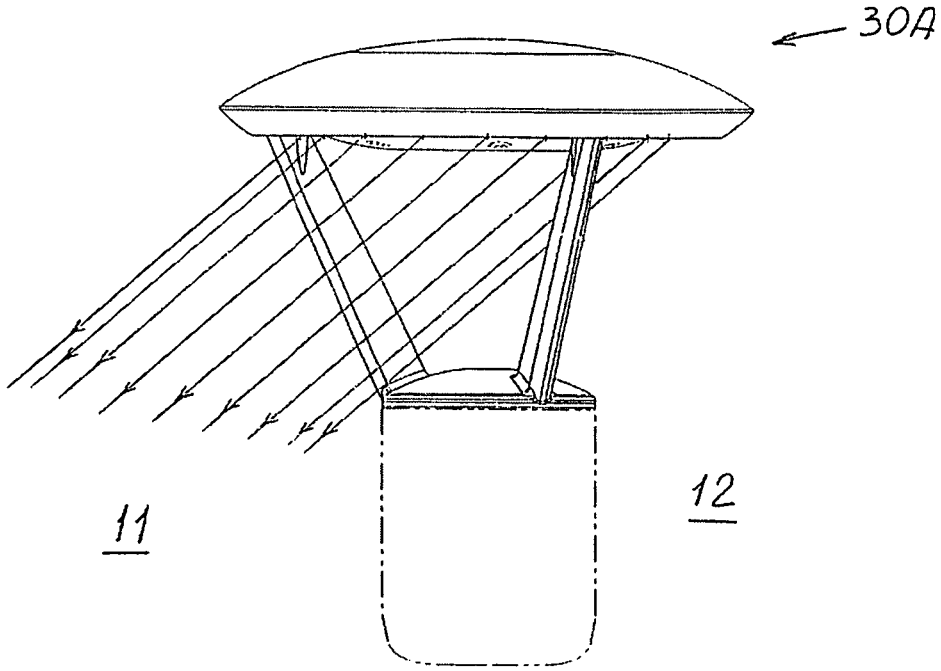
FIG. 17 is a front elevation of FIG. 16.
Figure 18:
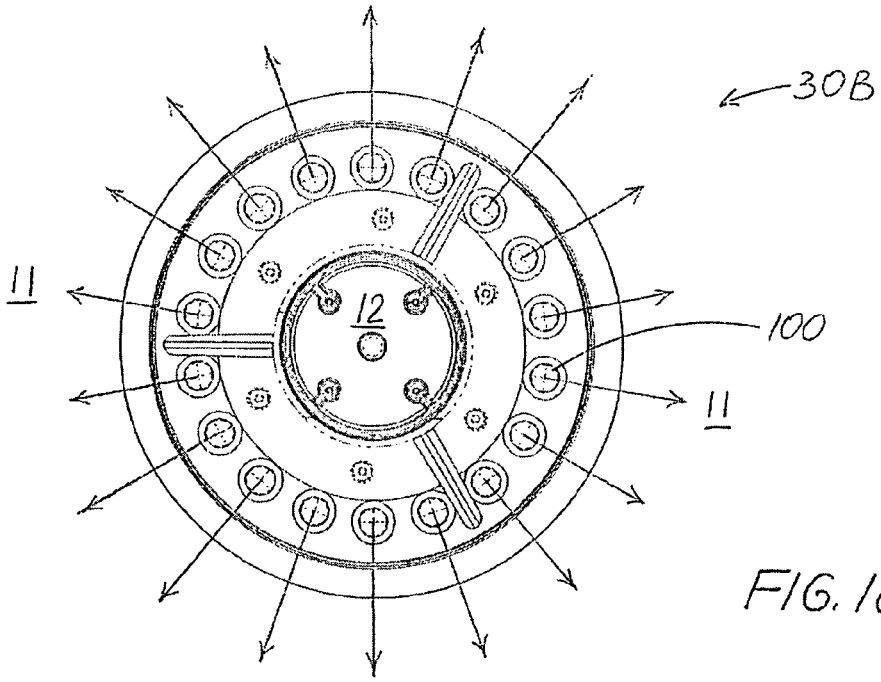
FIG. 18 is a bottom plan view as in FIG. 16, but of a lighting fixture with illumination toward different radial directions for illumination of a wide area.
Figure 19:
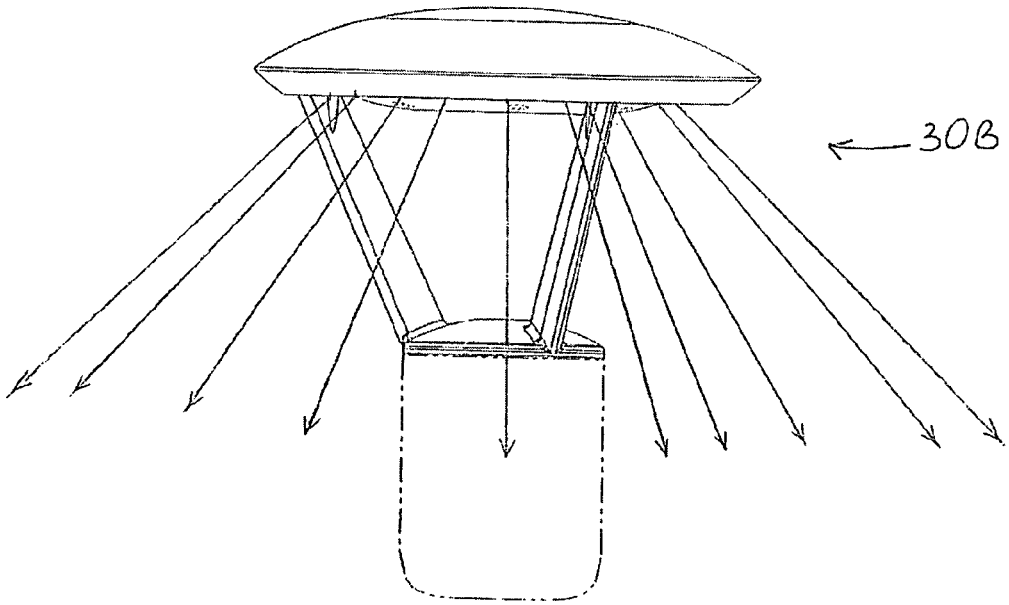
FIG. 19 is a front elevation of FIG. 18.

FIGS. 16 and 17 illustrate a lighting fixture 30A in which lenses 40 have their preferential sides 11 in the same lateral direction, thereby to facilitate illumination toward one lateral direction. FIGS. 18 and 19 show a lighting fixture 30B in which lenses 40 have their preferential sides 11 oriented in a substantially radially outward directions with respect to the circular pattern to give broad illumination which is generally symmetrical with respect to fixture 30B, as shown.

While FIGS. 1-3 and 5-14 illustrate lensing members 40 as separate pieces, it should be recognized that in certain light-fixture uses utilizing a plurality of lensing members 40, such as the fixtures illustrated in FIGS. 15-19, lensing members 40 could be incorporated into a single formed member with each lens oriented in the desired direction.

Figure 21:
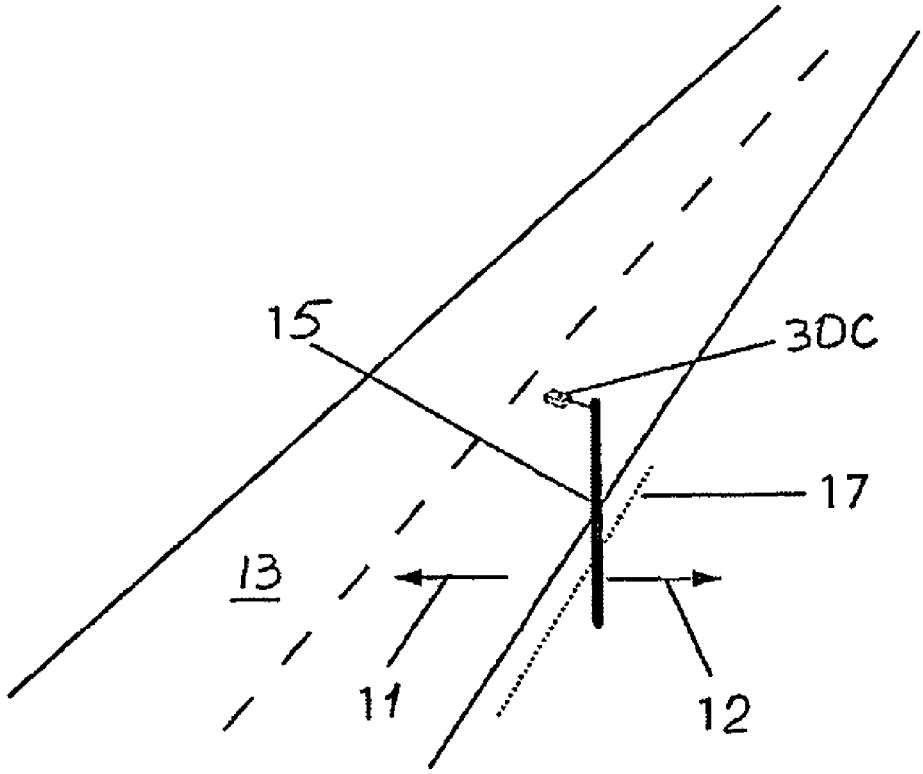
FIG. 21 is a schematic perspective representation of a pole-mounted lighting fixture in accordance with the present invention, the pole being positioned along the side of a roadway.

Referring now to FIG. 21, a roadway 13 is schematically illustrated with a light fixture 30C, which is in accordance with this invention, mounted at the top of a light pole 15 installed along roadway 13, with lighting fixture 30C positioned over the curb, which is illustrated by a curb line 17 (shown in dotted line). The direction arrow marked by reference number 11 indicates a preferential side (toward the roadway), and the direction arrow marked by reference number 12 points toward the opposite, non-preferential side.

Figure 20:
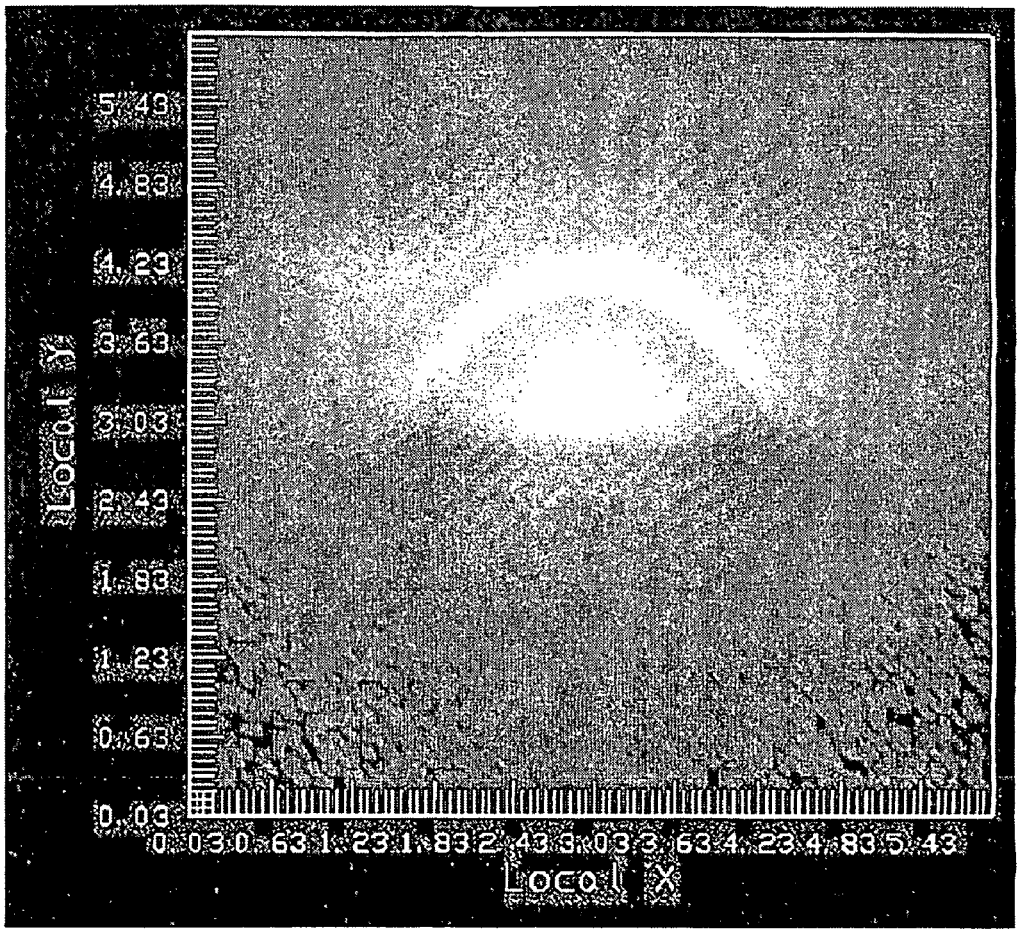
FIG. 20 is a two-dimensional plot of illumination intensity distribution of the inventive light-directing apparatus of FIG. 1.

FIG. 20 illustrates relative intensity distribution 61 by inventive light-directing apparatus 10, demonstrating that a great majority of the light emanating from apparatus 10 is redirected toward the preferential side 11, with no more than a minimal light reaching the non-preferential side 12. In other words, the amount of "trespass light" is minimized.

Figure 20A:
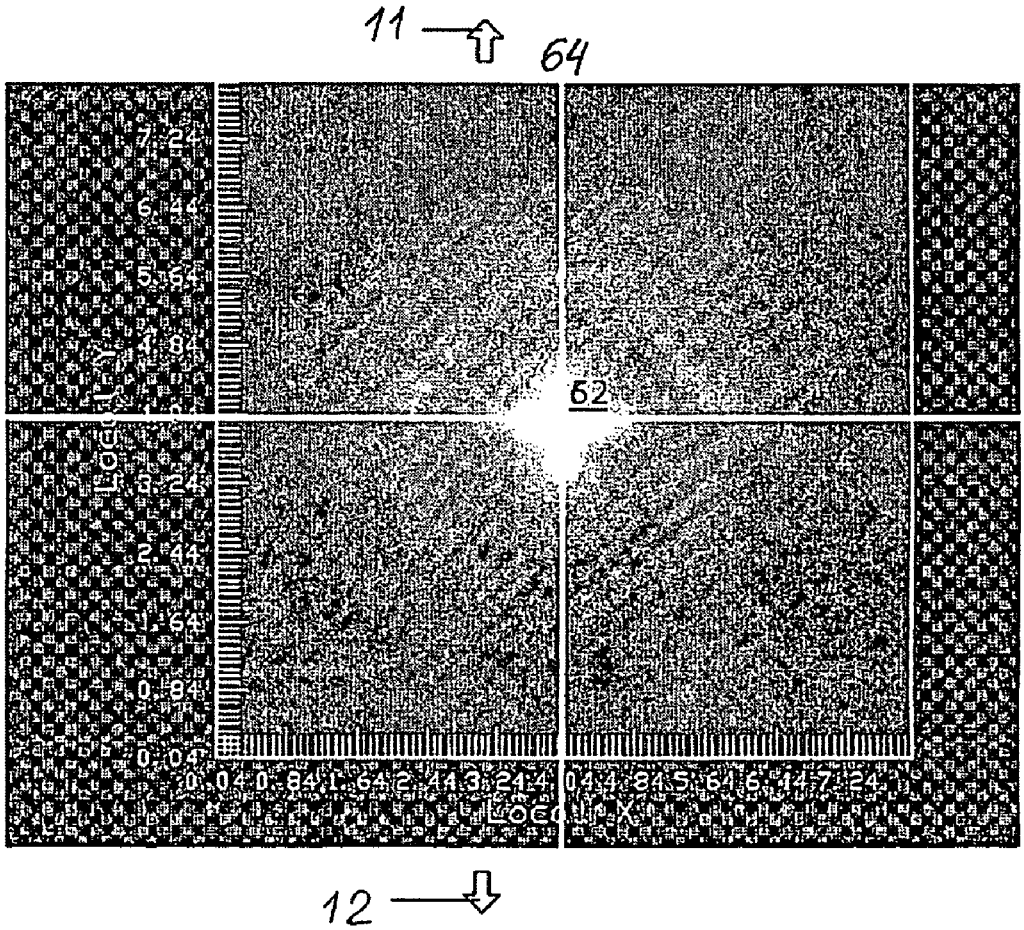
FIG. 20A is a two-dimensional plot of illumination intensity distribution, but from a comparable apparatus not incorporating the present invention.

FIG. 20A provides a comparison to show the advantaged of the invention. FIG. 20A is a two-dimensional illumination intensity distribution 62 by single-light-emitter 20 with single primary lens 23 and a secondary lens which is substantially comparable in design to lensing member 40 but for the fact that it does not accommodate an inserted or embedded shield member. The illumination pattern 62 in FIG. 20A shows, among other things, a greater amount of light toward the non-preferential side 12 than is the case in FIG. 20, which was generated using the present invention.

Light patterns 61 and 62 were generated using optical ray-tracing software to simulate the illumination intensity emanating from the respective apparatus.

While the principles of this invention have been described in connection with specific embodiments, it should be understood clearly that these descriptions are made only by way of example and are not intended to limit the scope of the invention.

The invention claimed is:

1. A light-directing apparatus for off-axial preferential-side distribution of light from a light emitter having an emitter axis, comprising:

a lensing member positioned over the light emitter and having:

a proximal end substantially transverse the emitter axis and defining a shield-insertion opening;

an inner surface defining an off-axis shield-receiving void extending from the shield-insertion opening; and an outer surface configured for refracting light from the emitter in a predominantly off-axial direction toward a preferential side; and a shield member snugly received in the shield-receiving void in a position in the path of light emitted toward a non-preferential side, the shield member including:

a shield portion extending into the path of light emitted toward the non-preferential side and including a reflective front surface in the path of light emitted toward the non-preferential side to redirect such light toward the preferential side; and a base portion extending from the shield portion away from the light emitter at the proximal end of the lensing member.

2. The light-directing apparatus of claim 1 wherein the proximal end of the lensing member further defines an emitter-insertion opening and the inner surface defines an emitter-receiving void extending from the emitter-insertion opening and facing the emitter.

3. The light-directing apparatus of claim 2 wherein the shield-insertion opening and the emitter-receiving opening are in communication and form a single proximal-end opening.

4. The light-directing apparatus of claim 3 wherein the shield-receiving void is contiguous with the emitter-receiving void.

5. The light-directing apparatus of claim 1 wherein the reflective front surface is entirely within the lensing member.

6. The light-directing apparatus of claim 5 wherein the reflective front surface of the shield member is of non-planar configuration.

7. The light-directing apparatus of claim 6 wherein the reflective front surface of the shield member has a plurality of sections angled with respect to each other.

8. The light-directing apparatus of claim 7 wherein the sections are each substantially planar.

9. The light-directing apparatus of claim 1 wherein the light emitter comprises an LED.

10. The light-directing apparatus of claim 1 wherein:

the light emitter is an LED package including at least one LED and a primary lens over the LED;

the lensing member is a secondary lens placed over the primary lens; and the shield member includes a reflective front surface generally facing the primary lens.

11. The light-directing apparatus of claim 1 wherein the lensing member includes an outward flange around the opening at the proximal end.

12. A lighting fixture with a plurality of light emitters spaced from one another on a mounting board, each light emitter having an emitter axis substantially parallel to the axes of the other light emitters, and a light-directing apparatus positioned over the light emitters for off-axial preferential-side distribution of light from the emitters, the light-directing apparatus comprising:

a plurality of lensing members each positioned over one light emitter and each having:

a proximal end substantially transverse the emitter axis and defining a shield-insertion opening;

an inner surface defining an off-axis shield-receiving void extending from the shield-insertion opening; and an outer surface configured for refracting light from the emitter in a predominantly off-axial direction toward a preferential side; and a plurality of shield members snugly received in the shield-receiving void of the corresponding lensing member in a position in the path of light emitted toward a non-preferential side, each shield member including:

a shield portion extending into the path of light emitted toward the non-preferential side and including a reflective front surface in the path of light emitted toward the non-preferential side to redirect such light toward the preferential side; and a base portion extending from the shield portion away from the light emitter at the proximal end of the lensing member.

13. The lighting fixture of claim 12 wherein the proximal end of the lensing member further defines an emitter-insertion opening and the inner surface defines an emitter-receiving void extending from the emitter-insertion opening and facing the emitter.

14. The lighting fixture of claim 13 wherein the shield-insertion opening and the emitter-receiving opening are in communication and form a single proximal-end opening.

15. The lighting fixture of claim 14 wherein the shield-receiving void is contiguous with the emitter-receiving void.

16. The light-directing apparatus of claim 12 wherein the reflective front surface is entirely within the lensing member.

17. The light-directing apparatus of claim 16 wherein the reflective front surface of the shield member is of non-planar configuration.

18. The light-directing apparatus of claim 12 wherein the light emitter comprises an LED.

19. The light-directing apparatus of claim 12 wherein the lensing member includes an outward flange around the opening at the proximal end.

20. A light-directing apparatus for off-axial preferential-side distribution of light from a light emitter having an emitter axis, comprising:

a lensing member positioned over the light emitter and having:

a proximal end substantially transverse the emitter axis and defining a shield-insertion opening;

an inner surface defining an off-axis shield-receiving void extending from the shield-insertion opening; and an outer surface configured for refracting light from the emitter in a predominantly off-axial direction toward a preferential side; and a shield member snugly received in the shield-receiving void in a position in the path of light emitted toward a non-preferential side, the shield member including a reflective front surface entirely within the lensing member in the path of light emitted toward the non-preferential side to redirect such light toward the preferential side, the reflective front surface being of non-planar configuration and having a plurality of sections angled with respect to each other, each section being substantially planar.

21. A lighting fixture with a plurality of light emitters spaced from one another on a mounting board, each light emitter having an emitter axis substantially parallel to the axes of the other light emitters, and a light-directing apparatus positioned over the light emitters for off-axial preferential-side distribution of light from the emitters, the light-directing apparatus comprising:

a plurality of lenses each positioned over one light emitter and each having:

a proximal end transverse the emitter axis; and an outer surface configured for refracting light from the emitter; and a plurality of shield members each disposed within the corresponding lens in a position in the path of light emitted from the corresponding light emitter toward a non-preferential side, each shield member including a reflective front surface entirely within the corresponding lens in the path of light emitted by the corresponding light emitter toward the non-preferential side to redirect such light toward the preferential side, the reflective front surface being of non-planar configuration and having a plurality of sections angled with respect to each other, the sections being each substantially planar.

22. The lighting fixture of claim 21 wherein each lens is a separate piece.

23. The lighting fixture of claim 21 wherein the lenses have preferential sides in the same lateral direction, thereby to facilitate illumination toward one lateral direction.

24. The lighting fixture of claim 21 wherein the lenses have preferential sides in different lateral directions, thereby to facilitate illumination in different lateral directions.

25. The lighting fixture of claim 24 wherein:

the lenses are arranged in a substantially circular pattern; and each lens has a preferential side oriented in a substantially radially outward direction with respect to the circular pattern.

26. The lighting fixture of claim 21 wherein:

the proximal end of each lens defines a shield-insertion opening and an emitter-insertion opening; and each lens includes an inner surface which defines an off-axis shield-receiving void extending from the shield-insertion opening and an emitter-receiving void extending from the emitter-insertion opening and facing the corresponding emitter.

27. The lighting fixture of claim 26 wherein each shield member is snugly received in the shield-receiving void of a corresponding one of the lenses.

28. The lighting fixture of claim 21 wherein each shield member is embedded by the lensing member having been molded thereabout.

29. The light-directing apparatus of claim 21 wherein the light emitter comprises an LED.

30. The lighting fixture of claim 21 wherein:

each light emitter is an LED package including at least one LED and a primary lens over the LED;

each lens is a secondary lens placed over a corresponding primary lens; and each shield member includes a reflective front surface generally facing the primary lens.

31. The lighting fixture of claim 30 wherein each secondary lens is a separate piece.

* * * * *